US008944929B1

(12) United States Patent
Smith

(10) Patent No.: US 8,944,929 B1
(45) Date of Patent: Feb. 3, 2015

(54) GOLF GRIP PRESSURE TRAINING DEVICE

(71) Applicant: Timothy M. Smith, Jacksonville, NC (US)

(72) Inventor: Timothy M. Smith, Jacksonville, NC (US)

( * ) Notice: Subject to any disclaimer, the term of this patent is extended or adjusted under 35 U.S.C. 154(b) by 0 days.

(21) Appl. No.: 14/065,572

(22) Filed: Oct. 29, 2013

(51) Int. Cl.
*A63B 69/36* (2006.01)

(52) U.S. Cl.
CPC ..... *A63B 69/36* (2013.01)
USPC ..... 473/202; 473/224; 473/549

(58) Field of Classification Search
USPC ..... 473/201, 202, 206, 219, 220, 221, 222, 473/223, 224, 226, 459, 463, 524, 549–553
See application file for complete search history.

(56) References Cited

U.S. PATENT DOCUMENTS

| | | | | |
|---|---|---|---|---|
| 4,861,034 | A * | 8/1989 | Lee | 473/202 |
| 5,377,541 | A | 1/1995 | Patten | |
| 5,542,676 | A * | 8/1996 | Howe et al. | 473/202 |
| 5,681,993 | A * | 10/1997 | Heitman | 73/379.02 |
| 6,716,034 | B2 | 4/2004 | Casanova, Jr. et al. | |
| 7,837,575 | B2 | 11/2010 | Lee et al. | |
| D629,480 | S | 12/2010 | Garsen | |
| 8,033,916 | B2 | 10/2011 | Caldwell et al. | |

* cited by examiner

*Primary Examiner* — Nini Legesse

(57) ABSTRACT

A golf grip pressure training device provides feedback based on grip pressure exerted on a golf club grip. The device includes a grip having a top end, a bottom end, and a perimeter wall coupled to and extending from the top end to the bottom end. The bottom end is open wherein the grip is configured for being coupled to a golf club by inserting the golf club into the bottom end of the grip. A plurality of pressure sensors is positioned in the grip. A plurality of indicators are also coupled to the grip. Each indicator is communicatively coupled to an associated one of the sensors wherein the indicator is actuated upon the associated pressure sensor detecting pressure on the grip. Each pressure sensor detects a unique amount of pressure on the grip wherein the indicators are sequentially actuated as pressure on the grip is increased.

12 Claims, 3 Drawing Sheets

GOLF GRIP PRESSURE TRAINING DEVICE

BACKGROUND OF THE DISCLOSURE

Field of the Disclosure

The disclosure relates to golf training devices and more particularly pertains to a new golf training device for providing feedback based on grip pressure exerted on a golf club grip.

SUMMARY OF THE DISCLOSURE

An embodiment of the disclosure meets the needs presented above by generally comprising a grip having a top end, a bottom end, and a perimeter wall coupled to and extending from the top end to the bottom end. The bottom end is open wherein the grip is configured for being coupled to a golf club by inserting the golf club into the bottom end of the grip. A plurality of pressure sensors is positioned in the grip. A plurality of indicators are also coupled to the grip. Each indicator is communicatively coupled to an associated one of the sensors wherein the indicator is actuated upon the associated pressure sensor detecting pressure on the grip. Each pressure sensor detects a unique amount of pressure on the grip wherein the indicators are sequentially actuated as pressure on the grip is increased.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
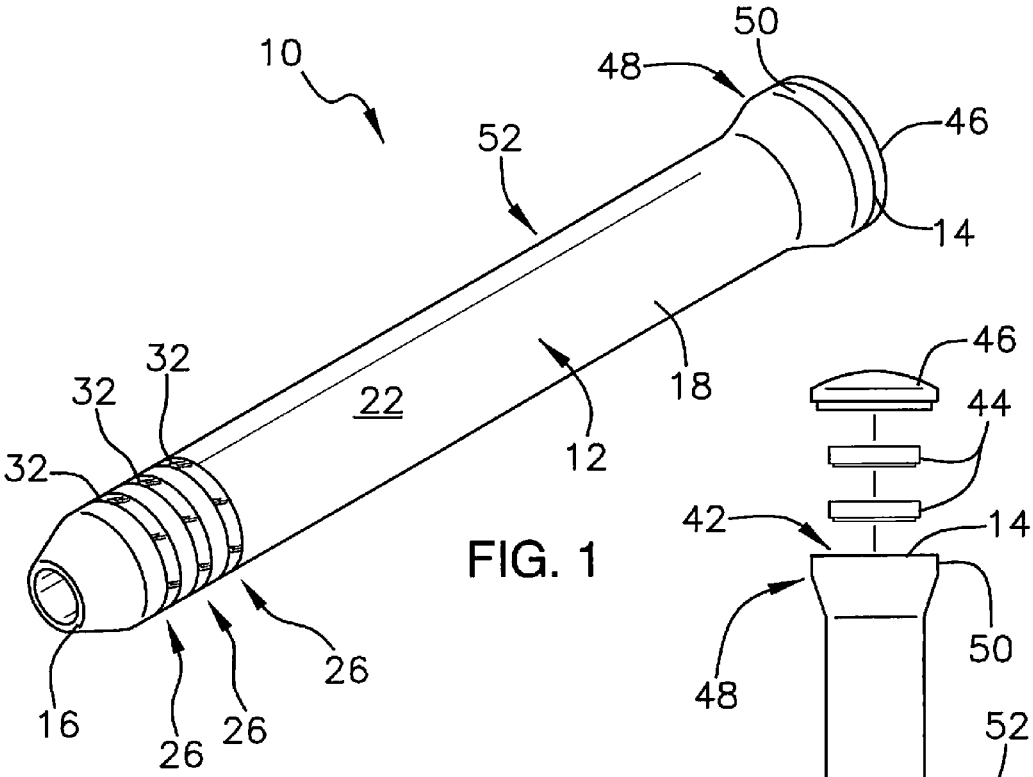
FIG. 1 is a bottom front side view of a golf grip pressure training device according to an embodiment of the disclosure.
Figure 2:
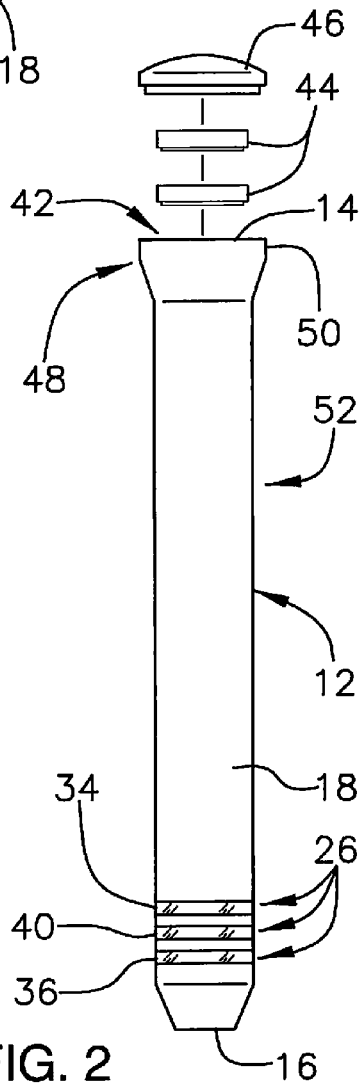
FIG. 2 is a front view of an embodiment of the disclosure.
Figure 3:
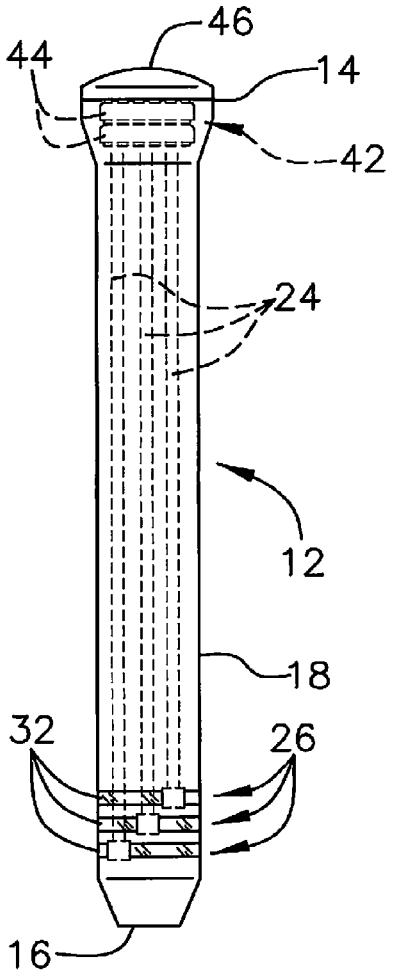
FIG. 3 is a back view of an embodiment of the disclosure.
Figure 4:
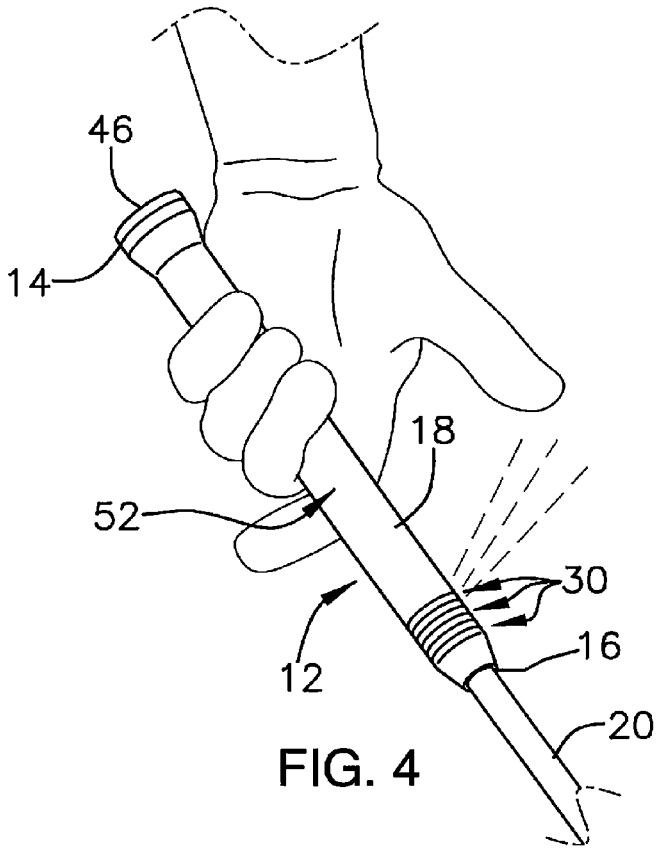
FIG. 4 is a bottom front side perspective view of an embodiment of the disclosure in use.
Figure 5:
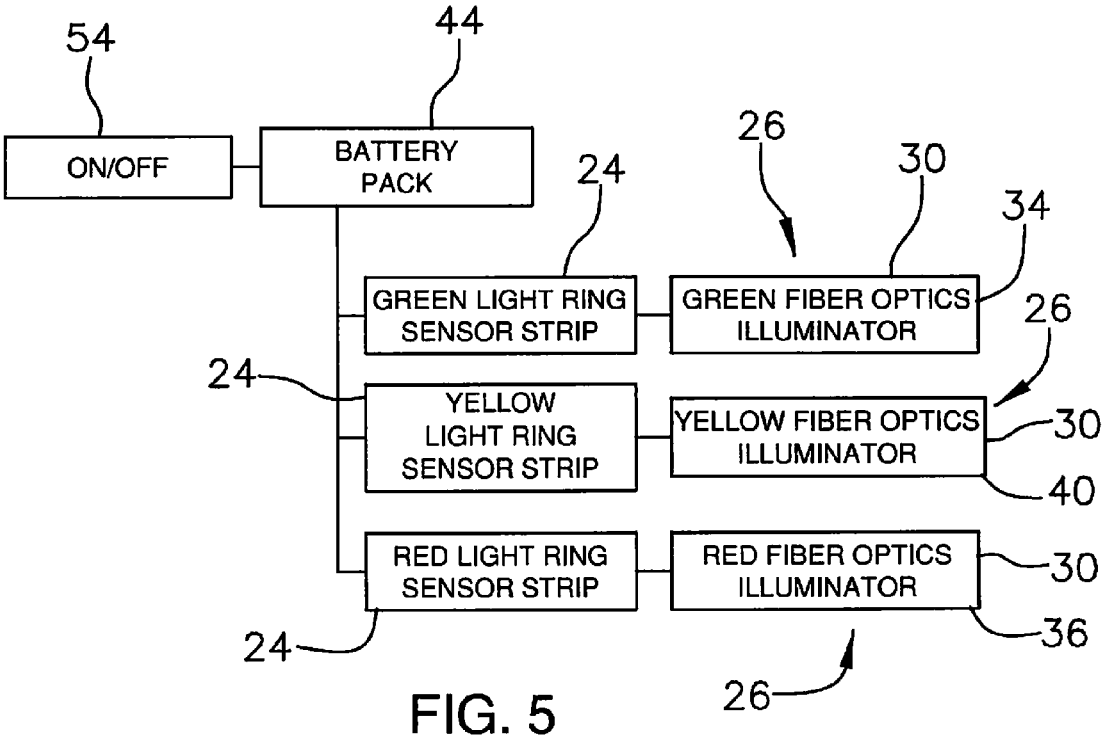
FIG. 5 is a schematic view of an embodiment of the disclosure.

With reference now to the drawings, and in particular to FIGS. 1 through 5 thereof, a new golf training device embodying the principles and concepts of an embodiment of the disclosure and generally designated by the reference numeral 10 will be described.

As best illustrated in FIGS. 1 through 5, the golf grip pressure training device 10 generally comprises a grip 12 having a top end 14, a bottom end 16, and a perimeter wall 18 coupled to and extending from the top end 14 to the bottom end 16. The bottom end 16 is open wherein the grip 12 is configured for being coupled to a shaft 20 of a golf club by inserting the shaft 20 of the golf club into the bottom end 16 of the grip 12 in a conventional manner. The grip 12 is constructed of rubber or the like used for making conventional club grips. An outer surface 22 of the grip 12 is designed to have a similar tackiness or frictional quality to conventional club grips such that practice using the device 10 will translate into muscle memory for playing golf using clubs with conventional golf grips.

Each of a plurality of pressure sensors 24 is positioned in the grip 12. The pressure sensors 24 may be embedded within the perimeter wall 18 of the grip 12. Each pressure sensor 24 is elongated and extends between the top end 14 and the bottom end 16 of the grip 12 such that each pressure sensor 24 is positioned to detect pressure exerted on the grip 12 while holding the golf club. Each of a plurality of indicators 26 is also coupled to the grip 12. Each indicator 26 is communicatively coupled to an associated one of the sensors 24 wherein the indicator 26 is actuated upon the associated pressure sensor 24 detecting pressure on the grip 12. Each pressure sensor 24 is designed to detect a unique amount or range of pressure on the grip 12 such that the indicators 26 are sequentially actuated as pressure on the grip 12 is increased. This may be achieved by having sensors 24 of varying sensitivity positioned in equally spaced relationship to the outer surface 22 of the grip 12, or by having equally sensitive sensors 24 positioned in varying depths within the perimeter wall 18 as measured from the outer surface 22 of the grip 12. Each indicator 26 may comprise a light 30, such as a light emitting diode or the like, visible on or when viewing the exterior surface 22 of the grip 12. Each indicator 26 may be a ring 32 extending fully around the grip 12 and positioned proximate the bottom end 16 of the grip 12 to be readily visible to a user while the user grasps the grip 12.

The indicators 26 include a first one of the indicators 34 being actuated upon the associated pressure sensor 24 detecting pressure within a first range corresponding to a desired amount of pressure exerted on the grip 12. The first range would be that known to the golf industry as the minimum and maximum amounts of pressure to exert on a conventional golf grip to execute a desirable golf swing as commonly taught by golf professionals. The first one of the indicators 34 may be a green light as this color is commonly associated with a desirable result or an indication that it is okay to proceed with the current grip pressure being exerted on the grip 12. A second one of the indicators 36 is actuated upon the associated pressure sensor 24 detecting pressure within a second range corresponding to an excessive amount of pressure exerted on the grip 12. Again, the second range would be that which is known within the golf community to be too great to be able to exert while executing a desired or proper golf swing. The second one of the indicators 36 may be a red light as this color is a common indicator of trouble. A third one of the indicators 40 may be used and actuated upon the associated pressure sensor 24 detecting pressure within a third range between the first range and the second range. Thus, the third range would correspond to a warning that the pressure being exerted on the grip 12 is in a range which is borderline between being desired and undesired as would be commonly understood by the golf industry. The third one of the indicators 40 may be a yellow light as this color corresponds to a requirement for caution. The ranges of pressure may overlap to provide simultaneous or sequential lighting of the indicators 26.

A compartment 42 may be positioned in the grip 12 positioned adjacent the top end 14 of the grip 12. The compartment 42 is accessible through the top end 14 of the grip 12. A battery 44 or the like is positioned in the compartment 42. The battery 44 is electrically coupled to each pressure sensor 24 and each indicator 26. A cap 46 is selectively couplable to the top end 14 of the grip 12. The cap 46 closes the compartment 42 and holds the battery 44 within the compartment 42 when the cap 46 is coupled to the top end 14 of the grip 12. A top section 48 of the grip 12 extends around the compartment 42. An outer surface 50 of the top section 48 is flared outwardly with respect to a medial section 52 of the grip 12 through which the pressure sensors 24 extend. A switch 54 is coupled to the grip 12. The switch 54 is operationally coupled to each pressure sensor 24 wherein the switch 54 selectively activates each pressure sensor 24 for detecting pressure on the grip 12. The switch 54 may be incorporated into twisting of the cap 46 to bring the battery 44 into and out of electrical engagement with the pressure sensors 24 and indicators 26.

In use, the grip 12 is installed on the shaft 20. The pressure sensors 24 are activated and the grip 12 is grasped in conventional fashion for using the golf club. The grip 12 may be coupled to a conventional golf club wherein the golf club may be used at a driving range or during a round of golf. The user may monitor illumination of the indicators 26 while grasping the grip 12 to adjust to a proper grip pressure and establish a habit of grasping the grip 12 with the desired amount of pressure to execute a proper golf swing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A golf grip pressure training device comprising:

a grip having a top end, a bottom end, and a perimeter wall coupled to and extending from said top end to said bottom end, said bottom end being open wherein said grip is configured for being coupled to a golf club by inserting the golf club into said bottom end of said grip;

a plurality of pressure sensors positioned in said grip, each said pressure sensor being elongated and extending between said top end and said bottom end;

a plurality of indicators coupled to said grip, each said indicator being communicatively coupled to an associated one of said sensors wherein said indicator is actuated upon said associated pressure sensor detecting pressure on said grip, each said indicator comprising a light visible on an exterior surface of said grip, each said indicator being a ring extending around said grip proximate said bottom end of said grip; and wherein each said pressure sensor detects a unique amount of pressure on said grip wherein said indicators are sequentially actuated as pressure on said grip is increased.

2. The device of claim 1, further comprising said indicators comprising a first one of said indicators being actuated upon said associated pressure sensor detecting pressure within a first range corresponding to a desired amount of pressure exerted on said grip.

3. The device of claim 2, further comprising said first one of said indicators being a green light.

4. The device of claim 2, further comprising said indicators comprising a second one of said indicators being actuated upon said associated pressure sensor detecting pressure within a second range corresponding to an excessive amount of pressure exerted on said grip.

5. The device of claim 4, further comprising said indicators comprising a third one of said indicators being actuated upon said associated pressure sensor detecting pressure within a third range between said first range and said second range.

6. The device of claim 5, further comprising said third one of said indicators being a yellow light.

7. The device of claim 4, further comprising said second one of said indicators being a red light.

8. The device of claim 1, further comprising:

a compartment positioned in said grip, said compartment being positioned adjacent said top end of said grip, said compartment being accessible through said top end of said grip; and a battery positioned in said compartment, said battery being electrically coupled to each said pressure sensor and each said indicator.

9. The device of claim 8, further comprising a cap selectively couplable to said top end of said grip, said cap closing said compartment when said cap is coupled to said top end of said grip.

10. The device of claim 8, further comprising a top section of said grip extending around said compartment, an outer surface of said top section being flared outwardly with respect to a medial section of said grip through which said pressure sensors extend.

11. The device of claim 1, further comprising a switch coupled to said grip, said switch being operationally coupled to each said pressure sensor wherein said switch selectively activates each said pressure sensor for detecting pressure on said grip.

12. A golf grip pressure training device comprising:

a grip having a top end, a bottom end, and a perimeter wall coupled to and extending from said top end to said bottom end, said bottom end being open wherein said grip is configured for being coupled to a golf club by inserting the golf club into said bottom end of said grip;

a plurality of pressure sensors positioned in said grip, each said pressure sensor being elongated and extending between said top end and said bottom end;

a plurality of indicators coupled to said grip, each said indicator being communicatively coupled to an associated one of said sensors wherein said indicator is actuated upon said associated pressure sensor detecting pressure on said grip, wherein each said pressure sensor detects a unique amount of pressure on said grip such that said indicators are sequentially actuated as pressure on said grip is increased, each said indicator comprising a light visible on an exterior surface of said grip, each said indicator being a ring extending around said grip proximate said bottom end of said grip, and wherein said indicators further comprise a first one of said indicators being actuated upon said associated pressure sensor detecting pressure within a first range corresponding to a desired amount of pressure exerted on said grip, said first one of said indicators being a green light, a second one of said indicators being actuated upon said associated pressure sensor detecting pressure within a second range corresponding to an excessive amount of pressure exerted on said grip, said second one of said indicators being a red light, and a third one of said indicators being actuated upon said associated pressure sensor detecting pressure within a third range between said first range and said second range, said third one of said indicators being a yellow light;

a compartment positioned in said grip, said compartment being positioned adjacent said top end of said grip, said compartment being accessible through said top end of said grip;

a battery positioned in said compartment, said battery being electrically coupled to each said pressure sensor and each said indicator;

a cap selectively couplable to said top end of said grip, said cap closing said compartment when said cap is coupled to said top end of said grip;

a top section of said grip extending around said compartment, an outer surface of said top section being flared outwardly with respect to a medial section of said grip through which said pressure sensors extend; and a switch coupled to said grip, said switch being operationally coupled to each said pressure sensor wherein said switch selectively activates each said pressure sensor for detecting pressure on said grip.

* * * * *